US009569962B2

(12) United States Patent
Schuller

(10) Patent No.: US 9,569,962 B2
(45) Date of Patent: Feb. 14, 2017

(54) METHOD FOR IDENTIFYING A VEHICLE DETECTED BY A SENSOR DEVICE

(71) Applicant: Audi AG, Ingolstadt (DE)

(72) Inventor: Florian Schuller, Ismaning (DE)

(73) Assignee: AUDI AG, Ingolstadt (DE)

( * ) Notice: Subject to any disclaimer, the term of this patent is extended or adjusted under 35 U.S.C. 154(b) by 162 days.

(21) Appl. No.: 14/439,546

(22) PCT Filed: Oct. 29, 2013

(86) PCT No.: PCT/EP2013/003241

§ 371 (c)(1),
(2) Date: Apr. 29, 2015

(87) PCT Pub. No.: WO2014/067646

PCT Pub. Date: May 8, 2014

(65) Prior Publication Data

US 2015/0302742 A1 Oct. 22, 2015

(30) Foreign Application Priority Data

Oct. 30, 2012 (DE) ..... 10 2012 021 403

(51) Int. Cl.
*G08G 1/01* (2006.01)
*G08G 1/017* (2006.01)
(Continued)

(52) U.S. Cl.
CPC ..... *G08G 1/017* (2013.01); *G08G 1/0175* (2013.01); *G08G 1/04* (2013.01); *G08G 1/163* (2013.01)

(58) Field of Classification Search
CPC ..... G08G 1/147; G08G 1/144; G08G 1/14; G08G 1/143; G08G 1/146; G07B 15/02
(Continued)

(56) References Cited

U.S. PATENT DOCUMENTS 5,872,525 A 2/1999 Fukasawa et al.
8,275,523 B2 9/2012 Krimbacher
(Continued)

FOREIGN PATENT DOCUMENTS

DE 35 38 908 5/1987
DE 102007018139 10/2008
(Continued)

OTHER PUBLICATIONS

International Search Report issued by the European Patent Office in International Application PCT/EP2013/003241 on Jan. 29, 2014.
(Continued)

*Primary Examiner* — Kerri McNally
*Assistant Examiner* — Sharmin Akhter
(74) *Attorney, Agent, or Firm* — Henry M. Feiereisen LLC.

(57) ABSTRACT

The invention relates to a method for assigning an identity certificate (I1, I2) transmitted by a vehicle (16, 18) to an object (O1, O2, O3, O4), which is detected by a sensor device (28) in identification apparatus (22) external to the vehicle. To this end, the identification apparatus receives the identity certificate (I1, I2), measures by means of the sensor device (28) a first value (V1) relating to at least one operating parameter of the object, receives a second value (V1, V2) of the vehicle (16, 18) relating to the at least one operating parameter and determined by the vehicle (16, 18) itself, compares the first value and the second value of each operating parameter with each other and assigns the identity certificate (I1) to the object (O1) if the two values for each operating parameter match.

14 Claims, 1 Drawing Sheet

(51) Int. Cl.
*G08G 1/04* (2006.01)
*G08G 1/16* (2006.01)

(58) Field of Classification Search
USPC ..... 340/932.2, 933, 937; 705/1.1, 13, 14.37, 705/32, 418; 701/23, 24, 410, 428, 444
See application file for complete search history.

(56) References Cited

U.S. PATENT DOCUMENTS

| | | | | |
|---|---|---|---|---|
| 2002/0021228 | A1 | 2/2002 | Amita | |
| 2005/0240323 | A1* | 10/2005 | Orita | B62D 15/027 701/28 |
| 2008/0263100 | A1 | 10/2008 | Van Engelshoven | |
| 2012/0274482 | A1* | 11/2012 | Chen | G08G 1/144 340/932.2 |
| 2012/0299749 | A1* | 11/2012 | Xiao | G08G 1/04 340/932.2 |

FOREIGN PATENT DOCUMENTS

| | | |
|---|---|---|
| DE | 102007059727 | 6/2009 |
| DE | 102008011539 | 6/2009 |
| DE | 102011077592 | 7/2012 |
| WO | WO 2004/015510 | 2/2004 |
| WO | WO 2011/128739 | 10/2011 |

OTHER PUBLICATIONS

Sae Fujii et al: "Cooperative Vehicle Positioning via V2V Communications and Onboard Sensors", in: Vehicular Technology Conference, 2011.

Nader Mazen Rabadi et al.: "'Drivers' Anonymity with a Short Message Length for Vehicle-to-Vehicle Communications Network", in: Consumer Communications and Networking Conference, 2008.

* cited by examiner

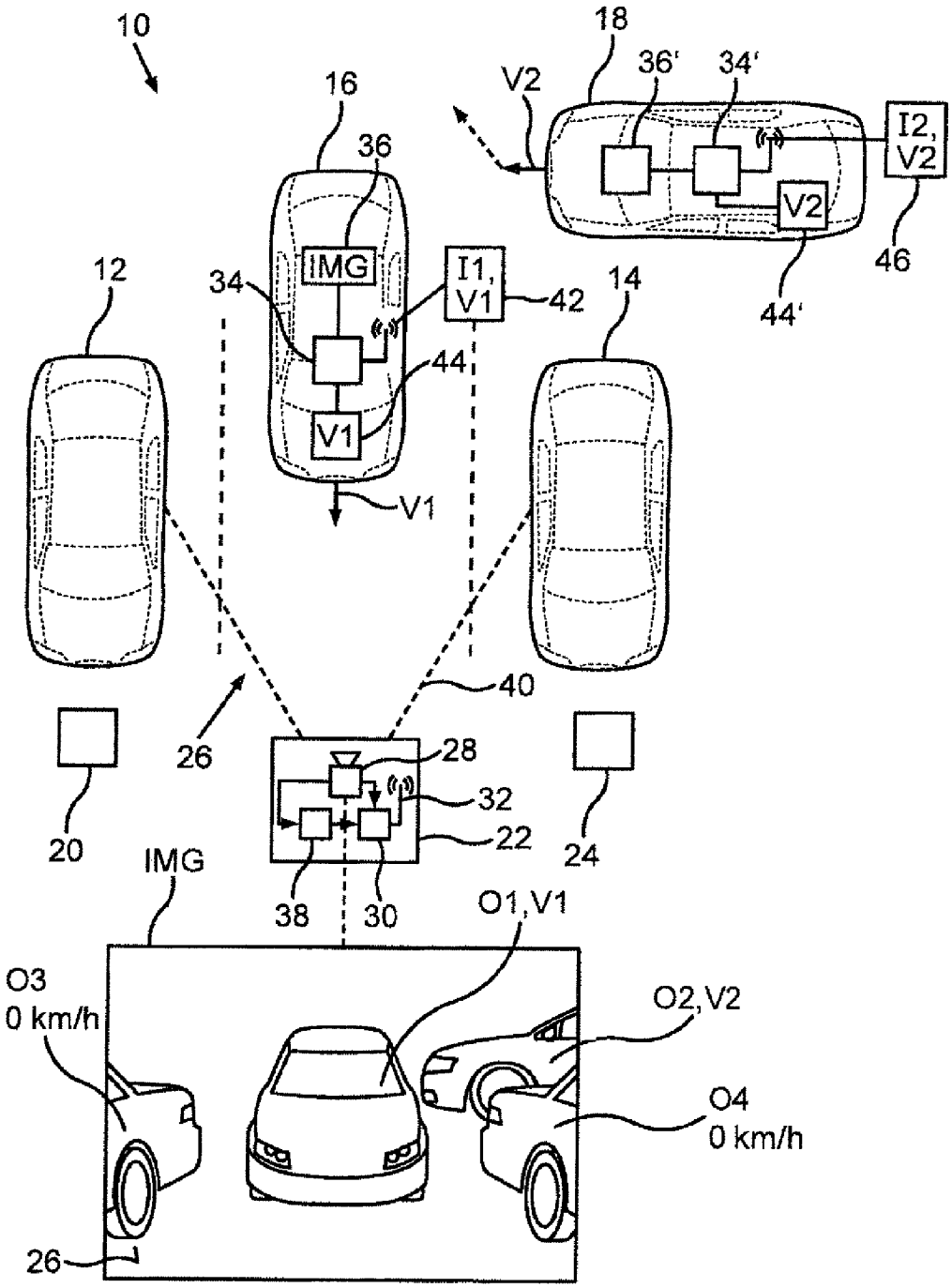
10
18
36'
34'
V2
16
36
I2,
V2
V2
46
44'
12
34
IMG
I1,
V1
42
14
44
V1
V1
40
26
28
32
22
20
24
IMG
38
30
O1,V1
O3
0 km/h
O2,V2
O4
0 km/h
26

METHOD FOR IDENTIFYING A VEHICLE DETECTED BY A SENSOR DEVICE

CROSS-REFERENCES TO RELATED APPLICATIONS

This application is the U.S. National Stage of International Application No. PCT/EP2013/003241, filed Oct. 29, 2013, which designated the United States and has been published as International Publication No. WO 2014/067646 A1 and which claims the priority of German Patent Application, Serial No. 10 2012 021 403.0, filed Oct. 30, 2012, pursuant to 35 U.S.C. 119(a)-(d).

BACKGROUND OF THE INVENTION

The invention relates to a method for verifying, whether an object detected by a sensor device is a particular vehicle of which it is known that the vehicle must be located in the vicinity of the sensor device. The invention also relates to a detection device with the sensor arrangement. The detection device is part of an infrastructure component, such as a gate, i.e. the detection device is installed external to a vehicle in an area that can be approached by the vehicle. The invention also relates to a motor vehicle, which is configured to communicate with the detection device. The motor vehicle may, for example, be a passenger car.

To assist a driver with maneuvering a vehicle in traffic, a corresponding sensor can be provided in a vehicle, which monitors the environment of the vehicle and which displays to the driver information about an obstacle located in the vicinity of the vehicle. Nowadays, many assistance functions exist for many different maneuvers (parking, passing, lane keeping assistance) so that the number of on-board sensors of the vehicle can be correspondingly large. DE 10 2011 077 592 A1 discloses removing some of the sensors of a lane-keeping assistance from the vehicle and installing them at the roadside in the form of transmission towers. Such a transmission tower then sends information that is necessary for providing corresponding assistance functionality to the passing vehicles.

Moving a sensor to an infrastructure component is especially difficult in relation to values that are measured individually for each vehicle. For example, a parking assistant can be realized at a parking lot by detecting with a vehicle-external sensor, for example an ultrasonic sensor or a camera, a vehicle moving onto the parking lot and transmitting the measured values to the vehicle for displaying to a driver the measured values, for example, the remaining space or even a picture of the rear of his vehicle, on a screen in the motor vehicle.

If two parking spaces next to each other are equipped with such an infrastructure component and if two vehicles are parking at the same time, it must be ensured that the distance values of the own vehicle are displayed to each driver on his screen.

A vehicle can be identified unambiguously and spatially using currently available techniques, which is necessary, for example, in the aforedescribed piloted parking application, only by installing additional devices in the vehicles and the infrastructure components and only by establishing clearly defined and spatially limited areas (e.g. a transit corridor with induction loop). In such a spatially limited area, an additional identification feature can then be received by the vehicle, for example from an RFID tag carried by the vehicle, or from a magnetic card inserted by the driver into a reading device), so that it can be made clear based on the identification feature in which area the infrastructure component is supposed to transmit the detected signals.

SUMMARY OF THE INVENTION

It is the object of the invention to make it possible to assign an identity certificate of a vehicle to an object detected by a sensor device while reducing equipment cost.

With the invention, an association between the vehicle and an object detected by the vehicle-external sensors can be established by measuring, for example, the vehicle movement with both on-board sensors and infrastructure-based sensors and by subsequently adjusting the respectively generated values and thereby initially identifying spatial position of the vehicle. The vehicle can be unambiguously identified by using additional features, such as an identification number that is exchanged between the vehicle and the external sensors via a wireless link.

The method according to the invention provides for this purpose the following steps for assigning an identification certificate transmitted by a vehicle to an object, for example, in an ultrasound image that represents the vehicle.

The identification certificate is first received by the detection device. A first value for a feature or operating parameter of the vehicle is determined from outside the vehicle with a sensor, for example an ultrasonic sensor. Such operating parameters may represent, for example, the aforementioned vehicle movement. The vehicle itself also determines the value for the vehicle relating to the vehicle movement, or generally the operating parameter. The value is then also transmitted by the vehicle. This value is also received by the detection device. The two values for the operating parameters (the one relating to the object and the one relating to the vehicle) are then compared. If they match, the identification certificate is assigned to the object. It can then be treated as the vehicle that has transmitted the identification certificate. For example, only one gate can now be opened when the ultrasonic sensor detects the approaching vehicle in the ultrasound image.

It will be understood that several operating parameters may be evaluated with the method. In a particularly preferred embodiment, at least one of the following operating parameters is evaluated by determining the values: a velocity of movement, a direction of movement, a pitch attitude, a roll attitude, a steering angle at least one wheel, a ground clearance, a wheelbase, a tire size, a weight, a color, a company logo visible on the vehicle or object, a condition of a vehicle lighting. The evaluation of several operating parameters makes the detection more robust. In order to facilitate the assignment even more, the identification certificate and the value of the at least one operating parameter determined by the vehicle itself are transmitted together by the vehicle in a single message.

With the method according to the invention, a vehicle can advantageously be unambiguously and spatially identified exclusively by using existing vehicle sensors and optionally frequently existing communication features as well as the already existing sensors on the infrastructure side that provide the assistance function. According to one embodiment of the method, the use of a wireless communication link, in particular a radio link or a communication link based on an RFID transponder (RFID—Radio Frequency Identification) is contemplated for transmitting the identification certificate and the values determined by the vehicle. According to one embodiment, WLAN technology (WLAN—Wireless Local Area Network) is used for a radio link. Other embodiments are directed to transmitting the identification certificate and the values via a cellular link (e.g. UMTS, GPRS, GMS, LTE) as well as via a Bluetooth link.

The identification certificate is typically a data set that can include a unique number or another unique string of symbols that is assigned to an object or a person for the purpose of identification. According to one embodiment of the method, the identification certificate is a data set that identifies the vehicle itself, for example, the chassis number of the vehicle. The identification certificate can also be used to identify a person. For example, according to one embodiment of the method, the driver can be identified when the identification certificate includes, for example, as a driver's license number of the driver. The vehicle owner can also be identified by a corresponding identification certificate. According to another embodiment of the method, the identification certificate identifies a contract partner for a particular contract, for example a tenant for a parking space on which the vehicle is to be parked. Access control for a vehicle can advantageously be provided by a corresponding choice of the identification certificate; for example, the access ramp to a parking garage with permanent parking spaces can be automatically monitored without requiring the driver to enter a PIN or to insert a magnetic card into a reading device each time when entering the parking garage.

For other services provided by an infrastructure component, it is sufficient to dynamically generate the identification certificate, i.e. independent from an original identity of the vehicle or of a person. The corresponding embodiment of the method according to the invention has the advantage of maintaining anonymity. For example, when a vehicle intending to park in a parking space intends to use an infrastructure component with a camera, it is sufficient to assign to the vehicle a dynamically generated identification certificate at the beginning of the parking maneuver so as to again always unambiguously identify the vehicle during the maneuver in the presence of ambiguous sensor signals, for example when a second vehicle enters the detection area of the camera and two moving objects are then visible in the camera image. A dynamically generated identification certificate may be valid for a limited time and may be issued, for example, only for performing a particular driving maneuver within the detection area of the sensor device. An identification certificate may also be generated and allocated via a server on the Internet or a cellular service.

According to an embodiment of the method according to the invention, the detection device repeatedly checks the credentials in a parking maneuver and other maneuvers where the assignment of the object must always be checked anew. For this purpose, the additional value for the at least one operating parameter is determined by the sensor device and additional determined values are also received by the vehicle itself. The vehicle also transmits each time its identification certificate together with these additional values. Thus, it can again always be verified during a driving maneuver whether an object observed by the sensor device is actually the parking vehicle and not, for example, a pedestrian crossing between the sensor device and the vehicle.

The repeated determination of values, for example of the velocity of a vehicle, is advantageously used in accordance with another embodiment of the method to track an object. By being able to always check, whether the tracked object is still the vehicle and not another also moving object, the plausibility of the object tracking is evaluated and hence becomes more robust. Object tracking (tracking) can be based on a known appropriate method, such as a Kalman filter.

A vehicle can be particularly easily assigned to a particular object with the aforedescribed comparison of the values, if the values are determined repeatedly and from the beginning, i.e. as soon as the vehicle enters a detection area of the sensor device. This ensures the unambiguity of the assignment also for a situation where, for example, two vehicles follow each other and thus have very similar velocities.

In a further development of the invention, a future trajectory of the vehicle is also estimated by the detection device. This allows bridging of temporary connection interruptions during the data transmission of the identification certificate or of the values determined by the vehicle due to interferences. Also radio silences between transmissions of values repeatedly determined by the vehicle can be bridged by the detection device.

According to an embodiment of the method, if the assignment of an identification certificate to a specific object detected by the sensor device is still ambiguous, for example, because several objects detectable by the sensor device transmitted identical or very similar values, the detection device transmits to the vehicle a command to change the value of the operating parameter or of another different feature. For example, the command may be: "Vehicle with the identity xy, please once activate the left turn signal and then once activate the right turn signal." The detection device then checks which of the objects detected by the sensor device performs the command. For example, such check may be performed with a camera.

As already described, the method according to the invention can be used in many different ways for automated spatial and unambiguous identification of vehicles. According to preferred embodiments of the method, when the two values of each operating parameter match, the detection device releases an access lane (for example, a gate will be opened in the parking garage) or a functionality for use by the vehicle is released (i.e., for example video images from a camera of a parking assistance are transmitted to the vehicle).

As already mentioned, the invention also includes an identification apparatus for verifying an identity of a vehicle. The identification apparatus includes a sensor device and a control device which is configured to perform an embodiment of the method according to the invention. Suitable sensor devices for implementing the aforedescribed embodiments of the method are in particular a camera as an imaging sensor device and a radar device and an ultrasound system as object-rendering sensor devices. Object-rendering sensor devices are to be understood as sensor devices where, unlike in imaging sensor devices, no contour image can be determined in the sensor device, but instead only for example an object focus whose trajectory can be tracked. In connection with the use of a camera, in particular a video camera can be provided (which enables detection of shape and color as well as of vehicle details), a PMD camera (PMD—Photonic Mixer Detector), which allows particularly accurate distance determinations, or an infrared camera, which also enables a temperature determination as an operating parameter value and which operates in particular independent of ambient lighting conditions, so that, for example, cast shadows do not affect the detection.

Lastly, the invention is also directed to a motor vehicle, which can cooperate in the aforedescribed manner with an identification apparatus of an infrastructure component. For this purpose, the motor vehicle has a device for determining a value of an operating parameter of the motor vehicle that can also be determined from outside the motor vehicle. Different, but known components of the vehicle can be used or provided depending on the operating parameter for which a value is to be determined. For example, the means may include a device for odometry, a sensor arrangement for determining the steering angle or a sensor arrangement for determining the velocity or e.g. also an accelerometer.

Not all operating parameters change during a trip. For example, a paint color of the motor vehicle and a company logo usually remain unchanged. In addition, these operating parameters cannot be measured simply with the commonly existing sensors of the motor vehicle. Therefore, in a further development of the motor vehicle of the invention, a memory is provided which configured to store a value for at least one of the operating parameters and to output the value to the transmission device for transmission. For example, the paint color can be permanently stored in such a memory. For example, the rim model can be stored in such a memory after a wheel change.

In the following, the invention will be once more explained in detail with reference to an actual embodiment. In the example described below, the described components of the embodiments each represent individual features of the invention to be considered independently of each other, with each feature also further developing the invention and therefore to be regarded as forming part of the invention individually or in another than the illustrated combination. Furthermore, the described embodiments can also be supplemented by other previously described features of the invention. The illustrated embodiments represent preferred embodiments of the invention.

BRIEF DESCRIPTION OF THE DRAWING

FIG. 1 shows a schematic diagram of a top view onto a parking lot.

DETAILED DESCRIPTION OF PREFERRED EMBODIMENTS

FIG. 1 shows a schematic diagram of a top view (bird's eye view) onto a parking lot 10. Two vehicles I2, 14 park in the parking lot 10. A third vehicle 16 is just being parked by a driver between the two parked vehicles I2, 14. A passing vehicle 18 just drives around the parking vehicle 16. The movement of the parking vehicle 16 is indicated by a velocity vector V1, the movement of the passing vehicle 18 by a motion vector V2. Infrastructure components 20, 22, 24 are provided on the parking lot 10, which can be used when parking. Hereinafter, only the infrastructure component 22 is described, and the other illustrated infrastructure components 20 and 24 can be constructed in the same manner.

The infrastructure component 22 may, for example, be a column fixedly connected to the ground, which may be placed at the end of a marked parking area 26. The infrastructure component 22 may include a sensor arrangement for detecting the parking vehicle 16, wherein the sensor arrangement may in this example include a camera 28. The parking area 26 is filmed with the camera 28. FIG. 1 shows as an example a single video frame IMG of a video sequence that can be detected by the camera 28. The infrastructure component 22 further includes a transmission device 30, which may be based, for example, on WLAN technology or Bluetooth technology. An antenna 32 emits a radio signal that may include the video sequence with the video image IMG. The parking vehicle 16 may include a respective communication device 34 configured to receive the radio signal from the antenna 32 and to extract the video sequence with the video image IMG contained therein from the signal and display, for example, the video sequence on a screen 36 of the vehicle 16. The driver of the vehicle 16 then sees his own vehicle from the point of view of the camera 28 and can thus maneuver the vehicle 16 more easily onto the parking area 26.

The passing vehicle 18 also has a communication device 34', which may correspond to the communication device 34 of the parking vehicle 16. A screen 36' may also be provided in the vehicle 18, on which a video sequence can be displayed by the communication device 34, which can be received via a radio signal.

In the present example, the video sequence with the video image IMG of the camera 28 is shown only on the screen 36 of the parking vehicle 16, but not on the screen 36'. An analyzing device 38 of the infrastructure component 22 performs in the video image IMG and also in the other images 28 in the video sequence of the camera an object segmentation by which objects O1, O2, O3, O4 recognizable, for example, in the video image IMG, are detected as separate components of the video image IMG. For the segmentation of individual objects, i.e. for their delineation in the individual sensor signals of the sensor device, generally known object recognition algorithms can be used in the context of the invention. The analyzing device 28 recognizes here that a total of four objects O1, O2, O3, O4 are located in a detection area 14 of the camera 28. The analyzing device 38 further recognizes that the object O1 moves to the parking area 26 and therefore must be an object to which the camera image IMG must be transmitted by the communication device 30.

The analyzing device 38 now determines where the video signal has to be transmitted. This is achieved according to the following description: The parking vehicle 16 transmits via its communication device 34 an identification feature I1, such as a vehicle number. However, the passing vehicle 18 may also transmit a different identification feature I2 via its communication device 34'. The identification features I1, I2 are identification certificates in the context of the invention. The identification feature I1 is contained in a message 42 which also includes an indication of a current velocity V1 of the parking vehicle 16. The actual velocity V1 is determined by a detection device 44 of the parking vehicle 16 and transmitted to the communication device 34. The identification feature I2 is accordingly contained in a message 46, which also contains information about an actual velocity V2 of the passing vehicle 18. With the determination of the actual velocity V2, the passing vehicle 18 also includes a detection device 44'.

The communication device 30 of the infrastructure component 22 receives both the message 42 and the message 46. The analyzing device 38 also determines for each of the objects O1, O2, O3, O4 detected in the video image IMG a velocity based the video data. The analyzing device 38 determines that the objects O3 and O4 do not move (0 km/h). A velocity value V1 is determined for the object O1, and velocity value V2 is determined for the object O2. The velocities represent operating parameters of the vehicles 16, 18, wherein conventional methods are available for their determination from the video sequence. The analyzing device 38 therefore determines that the object O1, which is just moving to the parking area 26, has the same velocity value V1 as contained in the message 42 of the vehicle 16. When the velocity information is compared in the context of the invention, a match can generally be ascertained even when the velocity information differ from each other by a predetermined tolerance value. The tolerance value may also depend from the absolute value of the velocity. In particular, a large tolerance is preferred at high velocities, whereas a smaller tolerance is preferred at lower velocities. The analyzing device 38 can now determine that the parking object O1 recognizable in the video image IMG must be the vehicle with the identification feature I1sein, which was contained in the same message 42 as the velocity value V1. The communication device 30 then transmits the video signal from the camera 28 to the vehicle having the identification feature I1, i.e. to the communication device 34 and not to the communication device 34'.

In the illustrated example, it is assumed that the communication device 34' of the vehicle 18 transmits the message 46 and other messages of the same type, because the vehicle 18 is moving toward an unillustrated gate which blocks, for example, access to an unillustrated parking garage. The driver of the vehicle 18 has leased a permanent parking space in the parking garage. An infrastructure component located next to the gate and possibly having a similar structure as the infrastructure component 22 detects the approaching vehicle 18, for example, with radar or an ultrasonic sensor and by segmenting the radar or ultrasound images as an approaching object. The identification feature I2 identifies the driver as the tenant of the parking space in the parking garage. When the vehicle 18 reaches the gate, the gate will open automatically. An analyzing device of the infrastructure component located next to the gate could unmistakably determine that the vehicle in front of the gate and recognizable in the radar or ultrasound image object must be the vehicle 18 whose driver has the right to the enter the parking garage. For this purpose, the same signal analysis was performed by the analyzing device, as was already described in connection with the analyzing device 38.

The example shows how a robust spatial allocation can also occur when several vehicles 16, 18 can be distinguished as objects O3, O4 in the detection area 40 of a sensor arrangement and when the trajectories of the individual vehicles are not restricted, i.e. when for example neither direction of travel nor a separate, pre-defined traffic lane is specified.

The own vehicle's movement is here preferably measured with sensors already existing in the vehicle (e.g. odometry, steering angle, velocity, acceleration, and the like). Object recognition is performed based on the input data and preferably the future movement of the objects (i.e. possibly one or more vehicles in the detection range) is predicted for the detection area of the external sensors (e.g. stereo/mono camera, laser scanner, PMD, and the like). The resulting hypotheses for the movement of the objects are exchanged between the external sensor arrangement (the infrastructure component) and the vehicles via a wireless link (WLAN, Bluetooth, etc.). The respective measured vehicle movement is continuously compared to produce an association between the vehicle and a detected object. The vehicle can thus be spatially unmistakably identified based on additional unique identifying features exchanged via the link. Furthermore, the identification features may be stored on a back-end server (for example an Internet server) and conceivably also dynamically adapted via an administration device. The identification certificate may also, for example, be an identification number for a wireless connection, for example an IP socket number for a WLAN connection.

What is claimed is:

1. A method for assigning an identification certificate transmitted by a vehicle to an object that is detected by a sensor device of a detection device external to the vehicle, wherein the detection device is part of an infrastructure component, the method comprising:

generating and assigning to the vehicle the identification certificate that is independent of an original identity of the vehicle or of a person and is valid for a limited duration;

with the sensor device, receiving the identification certificate;

with the sensor device, determining a first value for at least one operating parameter of the object;

with the sensor device, receiving a second value of the at least one operating parameter determined by the vehicle itself;

comparing the first value and the second value of each operating parameter with each other, and when the two respective values of each operating parameter match, assigning the identification certificate to the object.

2. The method of claim 1, wherein the at least one operating parameter comprises at least one operating parameter from the group consisting of: a movement velocity, a movement direction, a pitch attitude, a roll attitude, a steering of at least one wheel, a ground clearance, a wheelbase, a tire size, a weight, a color, a company logo, and a state of a vehicle lighting.

3. The method of claim 1, wherein the identification certificate and the second value are transmitted via a wireless communication link.

4. The method of claim 3, wherein the wireless communication link is a radio link or a link based on a RFID-transponder.

5. The method of claim 1, wherein the identification certificate identifies the vehicle or the person.

6. The method of claim 1, wherein the detection device determines for the operating parameters additional values and also receives additional values determined by the vehicle together with the identification certificate which is retransmitted, and wherein the identification certificate is repeatedly checked.

7. The method of claim 1, wherein the detection device determines a plurality of values of the at least one operating parameter and performs object tracking based on the determined values.

8. The method of claim 7, wherein the values are determined as soon as the vehicle moves into a detection area of the sensor device.

9. The method of claim 1, wherein the detection device estimates a future trajectory of the vehicle.

10. The method of claim 1, wherein the detection device transmits to the vehicle a command to modify the value of the at least one operating parameter or of another operating parameter, and wherein the detection device subsequently checks by using a camera which object detected by the sensor executes the command.

11. The method of claim 1, further comprising opening with the detection device a gate in a parking garage to allow access when the first value and the second value match.

12. The method of claim 1, further comprising transmitting with the detection device to the vehicle video images of a camera of a parking assist to release a functionality for use by the vehicle.

13. A detection device for verifying an identity of a vehicle, comprising:

a sensor device, and a control device, wherein the control device is configured to generate and assign to the vehicle an identification certificate that is independent of an original identity of the vehicle or of a person and is valid for a limited duration;

assign the identification certificate transmitted by the vehicle to an object that is detected by the sensor device of the detection device external to the vehicle, wherein the detection device is part of an infrastructure component, with the sensor device, receive the identification certificate; with the sensor device, determine a first value for at least one operating parameter of the object;

with the sensor device, receive a second value of the at least one operating parameter determined by the vehicle itself;

compare the first value and the second value of each operating parameter with each other, and when the two respective values of each operating parameter match, assign the identification certificate to the object.

14. The detection device of claim 13, wherein the sensor device comprises at least one sensor selected from the group consisting of a camera, a video camera, a stereo camera, a PMD (Photonic Mixer Detector) camera, an infrared camera, a laser scanner, a radar unit and an ultrasound system.

* * * * *